US010830157B2

(12) United States Patent
Ito

(10) Patent No.: US 10,830,157 B2
(45) Date of Patent: Nov. 10, 2020

(54) AIR INTAKE APPARATUS OF INTERNAL-COMBUSTION ENGINE AND AIR INTAKE FLOW CONTROL VALVE

(71) Applicant: AISIN SEIKI KABUSHIKI KAISHA, Kariya (JP)

(72) Inventor: Atsushi Ito, Anjo (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 0 days.

(21) Appl. No.: 16/507,119

(22) Filed: Jul. 10, 2019

(65) Prior Publication Data

US 2020/0025112 A1 Jan. 23, 2020

(30) Foreign Application Priority Data

Jul. 19, 2018 (JP) ..... 2018-136068

(51) Int. Cl.
*F02M 35/104* (2006.01)
*F02D 9/10* (2006.01)

(52) U.S. Cl.
CPC ..... *F02D 9/1015* (2013.01); *F02D 9/1025* (2013.01); *F02M 35/104* (2013.01)

(58) Field of Classification Search
CPC .... F02D 9/1015; F02D 9/1025; F02M 35/104
USPC ..... 123/306, 337, 184.53, 184.55, 184.56
See application file for complete search history.

(56) References Cited

U.S. PATENT DOCUMENTS 5,275,373 A * 1/1994 Kalippke ..... F02M 3/07 251/208
6,382,162 B2 * 5/2002 Umino ..... F02B 27/0278 123/184.55
6,561,160 B2 * 5/2003 Suzuki ..... F02D 9/16 123/337
6,591,804 B2 * 7/2003 Matsumoto ..... F02B 27/0278 123/184.55

(Continued)

FOREIGN PATENT DOCUMENTS

JP 4485541 B2 6/2010
JP 2014122553 A 7/2014

(Continued)

*Primary Examiner* — Hai H Huynh
(74) *Attorney, Agent, or Firm* — Buchanan Ingersoll & Rooney PC

(57) ABSTRACT

An air intake apparatus of an internal-combustion engine includes: an air intake passage communicating with a combustion chamber; an air intake flow control valve including a rotation shaft provided in the air intake passage and a valve body having a convex arc-shaped outer peripheral surface and opening and closing a main opening portion of the air intake passage, and controlling the intake air when the main opening portion is closed; a valve body storage portion provided in the air intake passage to have a concave arc shape corresponding to the valve body and storing the valve body when the main opening portion is opened; and a sub-opening portion provided between the outer peripheral surface and an inner surface of the valve body storage portion, allowing a portion of the intake air to pass therethrough and discharging the portion toward the intake air when the main opening portion is closed.

9 Claims, 8 Drawing Sheets

(56) References Cited

U.S. PATENT DOCUMENTS

| | | | | |
|---|---|---|---|---|
| 6,761,140 | B2 * | 7/2004 | Herold | F02B 31/06 123/184.21 |
| 8,118,007 | B2 * | 2/2012 | Sano | F02B 31/06 123/184.55 |
| 8,171,913 | B2 * | 5/2012 | Sano | F02D 9/103 123/184.56 |
| 8,985,087 | B2 * | 3/2015 | Matsuzaki | F16K 1/20 123/306 |
| 9,303,567 | B2 * | 4/2016 | Dickinson | F02D 9/08 |
| 9,341,108 | B2 | 5/2016 | Hattori | |
| 9,546,622 | B2 | 1/2017 | Ishihara | |
| 10,100,749 | B1 * | 10/2018 | Stoll, Jr. | F02D 9/10 |
| 10,267,272 | B2 * | 4/2019 | Ito | F02M 35/10262 |
| 10,539,103 | B2 * | 1/2020 | Ooki | F02M 35/10 |
| 2006/0102142 | A1 * | 5/2006 | Holder | F02B 31/06 123/308 |
| 2009/0050097 | A1 * | 2/2009 | Albiez | F02M 35/10255 123/184.56 |
| 2010/0000489 | A1 * | 1/2010 | Otaki | F02B 31/06 123/184.56 |
| 2010/0037853 | A1 | 2/2010 | Tsuchiya et al. | |

FOREIGN PATENT DOCUMENTS

| | | | |
|---|---|---|---|
| JP | 2016027265 | A | 2/2016 |
| JP | 2017089511 | A | 5/2017 |
| JP | 2017186962 | A | 10/2017 |

* cited by examiner (FIRST EMBODIMENT)

AIR INTAKE APPARATUS OF INTERNAL-COMBUSTION ENGINE AND AIR INTAKE FLOW CONTROL VALVE

CROSS REFERENCE TO RELATED APPLICATIONS

This application is based on and claims priority under 35 U.S.C. § 119 to Japanese Patent Application 2018-136068, filed on Jul. 19, 2018, the entire contents of which are incorporated herein by reference.

TECHNICAL FIELD

This disclosure relates to an air intake apparatus of an internal-combustion engine and an air intake flow control valve, particularly, to an air intake apparatus of an internal-combustion engine which is provided with an air intake flow control valve which controls an air intake flow by pivoting inside an air intake passage and an air intake flow control valve.

BACKGROUND DISCUSSION

In the related art, there is known an air intake apparatus or the like of an internal-combustion engine which is provided with an air intake flow control valve which controls an air intake flow by pivoting inside an air intake passage (for example, refer to JP 2017-89511A (Reference 1)).

Reference 1 discloses an air intake apparatus of an internal-combustion engine in which an air intake flow control valve is provided to be capable of pivoting inside an air intake passage. A sub-opening portion, which is a straight-shaped through hole, is directly provided in the air intake flow control valve. The air intake apparatus is configured to generate a tumble flow inside a combustion chamber by controlling an aperture of the air intake flow control valve. Here, the air intake flow control valve is configured to straighten the intake air which passes through a main opening portion by discharging the intake air which passes through a sub-opening portion toward the intake air which passes through the main opening portion in order to suppress a reduction in the flow speed due to the intake air which passes through the main opening portion of the air intake flow control valve being sucked into a rear surface side (a reverse side) of the air intake flow control valve which assumes a negative pressure.

In the air intake apparatus which is described in Reference 1, since, in accordance with the pivoting of the air intake flow control valve, the sub-opening portion, which is a straight-shaped through hole and is directly provided in the air intake flow control valve, also pivots, there is a problem in that there is a case in which the orientation of the intake air which passes through the sub-opening portion changes and the straightening of the intake air which passes through the main opening portion may not be effectively performed.

Thus, a need exists for an air intake apparatus of an internal-combustion engine and an air intake flow control valve which are not susceptible to the drawback mentioned above

SUMMARY

An air intake apparatus of an internal-combustion engine according to a first aspect of this disclosure includes an air intake passage which communicates with a combustion chamber of the internal-combustion engine and supplies an intake air to the combustion chamber, an air intake flow control valve including a rotation shaft which is provided in the air intake passage and a valve body which has a convex arc-shaped outer peripheral surface and opens and closes a main opening portion of the air intake passage by pivoting around an axial line of the rotation shaft, the air intake flow control valve controlling a flow of the intake air by pivoting the valve body when the main opening portion is closed, a valve body storage portion which is provided in the air intake passage to have a concave arc shape corresponding to a shape of the outer peripheral surface of the valve body and which stores the valve body when the main opening portion is opened, and a sub-opening portion which is provided between the outer peripheral surface of the valve body and an inner surface of the valve body storage portion, allows a portion of the intake air to pass therethrough and discharges the portion of the intake air toward the intake air which passes through the main opening portion when the main opening portion is closed.

In the air intake apparatus of the internal-combustion engine according to the first aspect of this disclosure as described above, the sub-opening portion which allows a portion of the intake air to pass therethrough to be discharged toward the intake air which passes through the main opening portion when the main opening portion is closed is provided between the outer peripheral surface of the valve body and the inner surface of the valve body storage portion. Accordingly, since the sub-opening portion is provided between the outer peripheral surface of the valve body and the inner surface of the valve body storage portion instead of being provided directly in the air intake flow control valve, it is possible to continuously discharge the intake air in the same direction from the sub-opening portion without pivoting the sub-opening portion, even if the air intake flow control valve pivots. Therefore, it is possible to cause the intake air which is discharged from the sub-opening portion to collide with the intake air which passes through the main opening portion at substantially the same position. As a result, it is possible to effectively perform the straightening of the intake air which passes through the main opening portion using the intake air which passes through the sub-opening portion. Therefore, since it is possible to suppress a reduction in the flow speed of the intake air which passes through the main opening portion, it is possible to improve the tumble ratio and to improve the fuel efficiency of the internal-combustion engine.

An air intake flow control valve according to a second aspect of this disclosure includes a rotation shaft which is provided in an air intake passage, and a valve body which has a convex arc-shaped outer peripheral surface and opens and closes a main opening portion of the air intake passage by pivoting around an axial line of the rotation shaft, in which the air intake flow control valve is configured to control a flow of the intake air by pivoting the valve body when the main opening portion is closed and to allow a sub-opening portion which is provided between an outer peripheral surface of the valve body and an inner surface of a valve body storage portion provided in the air intake passage to pass a portion of the intake air therethrough to discharge the portion of the intake air toward the intake air which passes through the main opening portion when the main opening portion is closed.

In the air intake flow control valve according to the second aspect of this disclosure, since the sub-opening portion is provided between the outer peripheral surface of the valve body and the inner surface of the valve body storage portion instead of being provided directly in the air intake flow control valve in the same manner as in the first aspect, it is possible to continuously discharge the intake air in the same direction from the sub-opening portion without pivoting the sub-opening portion, even if the air intake flow control valve pivots. Therefore, it is possible to cause the intake air which is discharged from the sub-opening portion to collide with the intake air which passes through the main opening portion at substantially the same position. As a result, it is possible to provide an air intake flow control valve in which it is possible to effectively perform the straightening of the intake air which passes through the main opening portion using the intake air which passes through the sub-opening portion. Therefore, since it is possible to suppress a reduction in the flow speed of the intake air which passes through the main opening portion, it is possible to improve the tumble ratio and to improve the fuel efficiency of the internal-combustion engine.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, a description will be given of an embodiment disclosed here based on the drawings.

First Embodiment

A description will be given of a configuration of an air intake apparatus 50 of an engine 100 (an example of an internal-combustion engine) according to the first embodiment disclosed here, with reference to FIGS. 1 to 7.

Configuration of Engine

Figure 1:
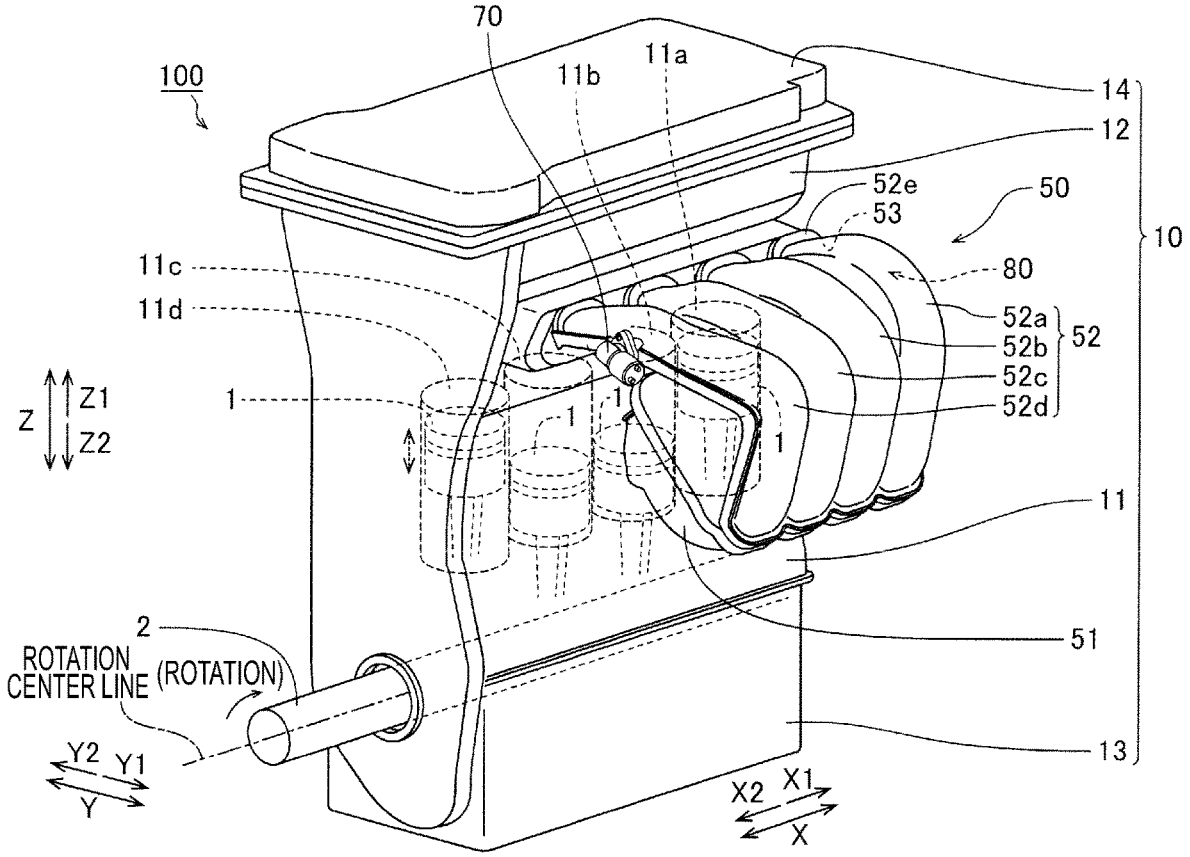
FIG. 1 is a perspective view illustrating a schematic configuration of an engine according to a first embodiment disclosed here.

As illustrated in FIG. 1, the engine 100 for a vehicle (an automobile) according to the first embodiment disclosed here is provided with an engine main body 10 and the air intake apparatus 50.

The engine main body 10 includes a cylinder block 11, a cylinder head 12, a crank case 13, and a head cover 14. The cylinder head 12 is fastened to a top surface (a Z1 direction side) of the cylinder block 11, the crank case 13 is fastened to a bottom surface (a Z2 direction side) of the cylinder block 11, and the head cover 14 covers and is fastened to a top portion of the cylinder head 12.

The engine 100, which is of an in-line four cylinder type, is configured to continuously repeat one cycle of suction, compression, expansion (combustion), and exhausting to rotate a crank shaft 2 due to pistons 1 moving reciprocally within four cylinders 11*a* to 11*d* which extend in up-down directions (Z directions). The directions (the X directions) in which the cylinders 11*a* to 11*d* are arranged are the directions in which the crank shaft 2 extends.

Figure 2:
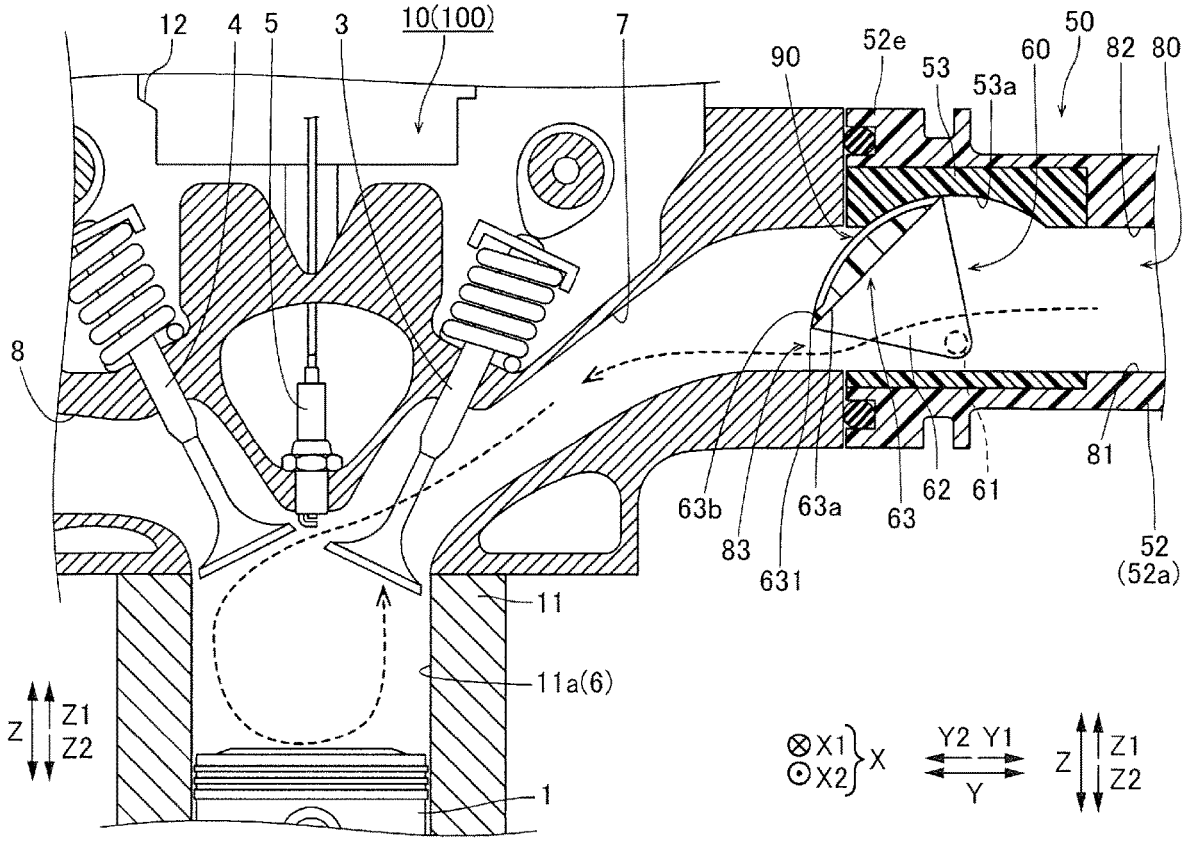
FIG. 2 is a sectional diagram illustrating a structure of the engine and an air intake apparatus according to the first embodiment disclosed here.

As illustrated in FIG. 2, an air intake valve 3 and an exhaust valve 4 which are periodically opened and closed, and an ignition plug 5 are embedded in the cylinder head 12. The cylinder head 12 includes a combustion chamber 6, an air intake port 7 which pumps the intake air into the combustion chamber 6, and an exhaust port 8 from which burned gas is exhausted. The air intake port 7, the combustion chamber 6, and the exhaust port 8 are disposed in the cylinder head 12 to correspond to each of the cylinders 11*a* to 11*d* (refer to FIG. 1) of the cylinder block 11. The air intake port 7 extends from the side surface of the cylinder head 12 toward the combustion chamber 6 while curving in a diagonally downward direction.

Configuration of Air Intake Apparatus

As illustrated in FIG. 2, the air intake apparatus 50 is provided with a surge tank 51 (refer to FIG. 1), an air intake tube portion 52 including air intake tubes 52*a* to 52*d* (refer to FIG. 1), a frame member 53, a TCV 60 (an example of an air intake flow control valve), an actuator 70 (refer to FIG. 1), an air intake passage 80 which is formed in the inner portion of the air intake apparatus 50, and a sub-opening portion 90. The air intake passage 80 communicates with the combustion chamber 6 and is configured to supply the intake air to the combustion chamber 6.

The air intake tube portion 52 is connected to the downstream side of the surge tank 51. The air intake tubes 52*a* to 52*d* are lined up along the directions (the X directions) in which the cylinders 11*a* to 11*d* (refer to FIG. 1) are arranged. Each of the air intake tubes 52*a* to 52*d* distributes the intake air which is accumulated in the surge tank 51 to the corresponding air intake port 7. The air intake tube portion 52 is connected to the side surface of the cylinder head 12 via a flange portion 52*e* which is formed integrally with a downstream end portion of the air intake tube portion 52.

The frame member 53 is fitted into the inside of the flange portion 52*e* on the same axis. The TCV 60 is provided in the frame member 53 to be capable of pivoting in order to control the flow (a degree of deflection) of the intake air.

Figure 3:
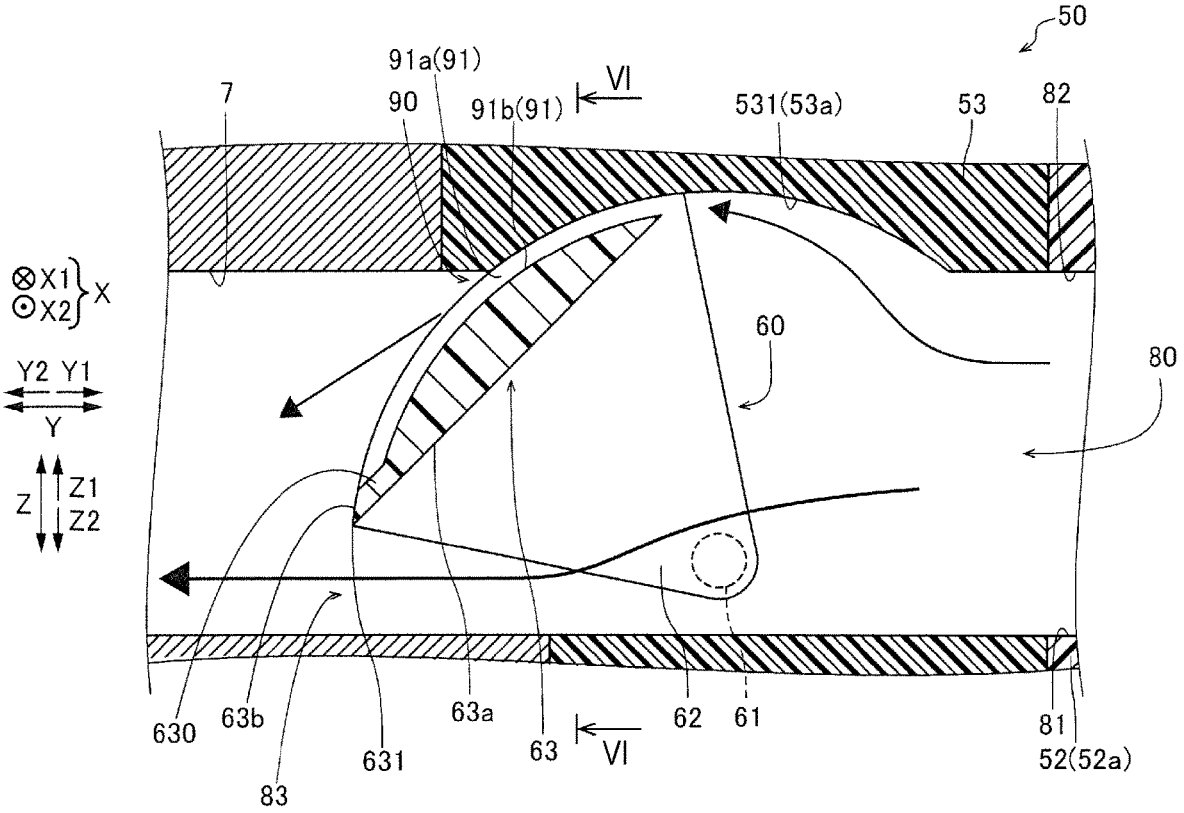
FIG. 3 is a view illustrating a state of an air intake flow while a TCV valve is closed according to the first embodiment disclosed here.

As illustrated in FIG. 3, the frame member 53 includes a valve body storage portion 53*a* which is formed in a portion of a top-side inner surface 82 and is depressed in a recessed shape to the top side. The TCV 60 is configured to assume a fully open state (a maximum flow path sectional area is obtained) (refer to FIG. 4) by being stored in the valve body storage portion 53*a*. The valve body storage portion 53*a* is provided in the air intake passage 80 so as to have a recessed circular arc shape corresponding to the shape of an outer peripheral surface 63*b* of a valve body 63 (described later)

of the TCV 60. The valve body storage portion 53*a* is configured such that the valve body 63 is stored in the valve body storage portion 53*a* while a main opening portion 83 (described later) is open. Therefore, the valve body storage portion 53*a* includes a curved inner surface 531.

Figure 4:
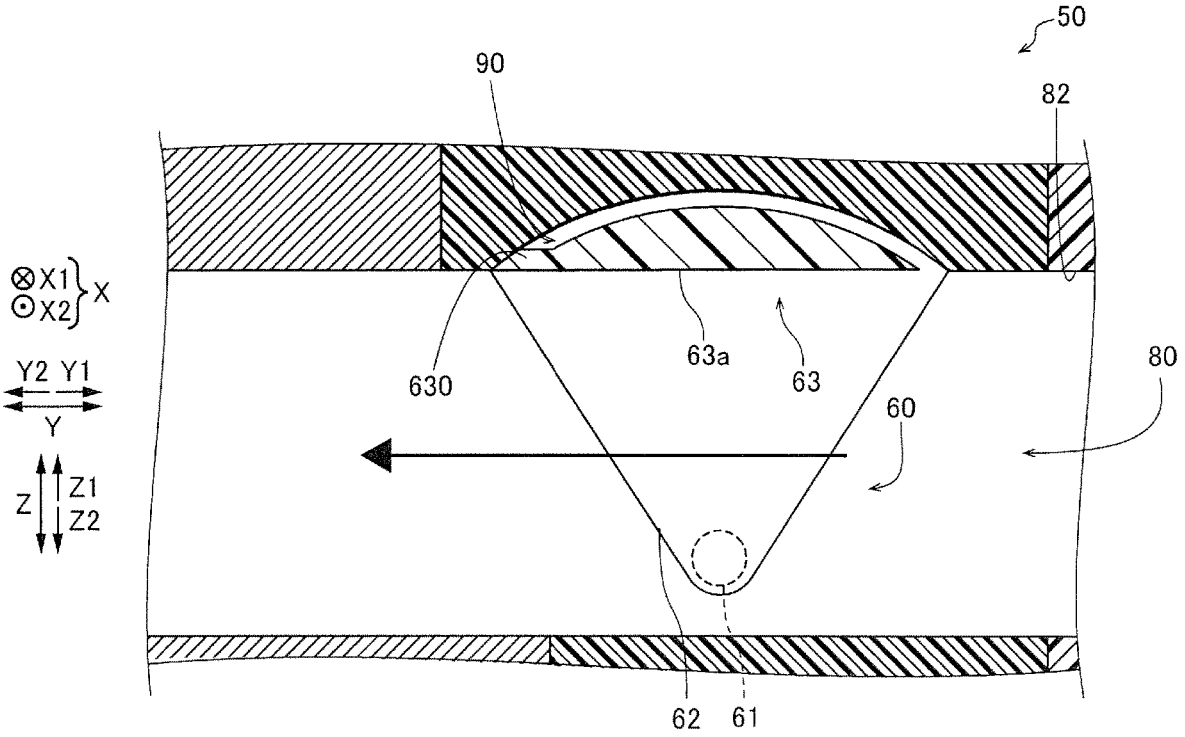
FIG. 4 is a view illustrating a state of the air intake flow while the TCV valve is open according to the first embodiment disclosed here.

As illustrated in FIG. 4, the top-side inner surface 82 is an inner surface on the Z1 direction side of each of the air intake tubes 52*a* to 52*d* (refer to FIG. 1). In a state (a fully open state of the main opening portion 83) in which the TCV 60 is completely stored in the valve body storage portion 53*a*, the top-side inner surface 82 of the air intake passage 80 and a blade surface 63*a* (described later) of the TCV 60 are flush surfaces (configure the same surface).

The actuator 70 (refer to FIG. 1) is embedded in the air intake apparatus 50 in order to drive the TCV 60. The actuator 70 is attached to the outside surface of the air intake tube portion 52 on the X2 direction side and is connected to a rotation shaft 61 of the TCV 60.

As illustrated in FIG. 3, the air intake apparatus 50 is configured to pivot the TCV 60 using the actuator 70 when performing the air intake to control (expand and contract) the opening area of the air intake passage 80 inside each air intake tube 52*a* (52*b* to 52*d*). In the engine 100, the aperture of the TCV 60 is ascertained using an ECU (not illustrated). The pivoting control of the TCV 60 is performed to achieve an optimal aperture corresponding to the operating state (the load state) of the engine 100 by the actuator 70 being driven based on the aperture information of the TCV 60.

In other words, in the air intake apparatus 50, the intake air which is to be supplied to the combustion chamber 6 is straightened by the TCV 60 pivoting (opening and closing). Specifically, when the TCV 60 is closed, the main opening portion 83 is formed between a rear edge part 631 of the valve body 63 and a bottom-side inner surface 81 of the air intake passage 80.

Due to the intake air being restricted by the main opening portion 83, a region in which the intake air which passes through the main opening portion 83 and has an increased flow speed is formed downstream of the region in which the main opening portion 83 is provided. Accordingly, a deflected flow along the vicinity of the bottom-side inner surface 81 in which the intake air flow speed is increased passes through the air intake port 7 and is carried to the combustion chamber 6. In the engine 100, a deflected flow which is generated in the air intake port 7 is guided to the combustion chamber 6 and a tumble flow (a longitudinal vortex) is generated inside the cylinder 11*a* due to the TCV 60 being pivoted to the closed side in a predetermined rotation frequency region (load state). The combustion efficiency of a mixed air is improved and an exhaust gas component containing nitrous oxides is improved by the tumble flow being controlled inside the cylinder 11*a* including the combustion chamber 6. Therefore, a configuration is adopted in which the pivoting (opening and closing) operation of the TCV 60 is controlled according to the operational state (the rotation frequency and the load state) of the engine 100.

Configuration of TCV

Figure 5:
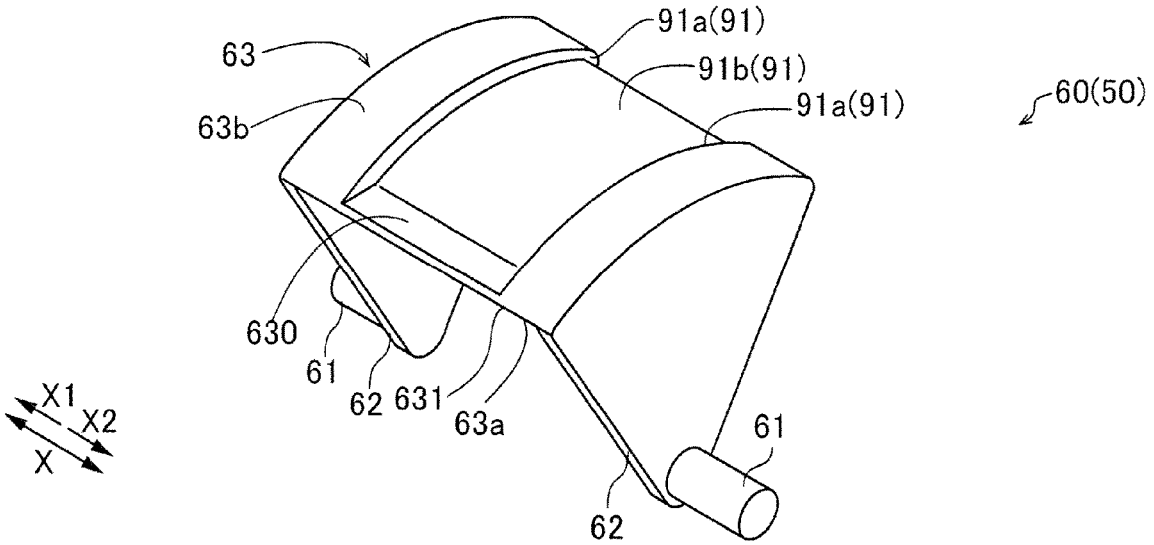
FIG. 5 is a perspective view illustrating the TCV according to the first embodiment disclosed here.

As illustrated in FIG. 5, the TCV 60 is formed of a resin material having excellent heat resistance. The TCV 60 includes the rotation shaft 61, a support portion 62, and the valve body 63.

The rotation shaft 61 is provided on both the X1 direction side and the X2 direction side of the air intake passage 80 (refer to FIG. 3). In other words, the rotation shaft 61 is configured as a pair. The pair of rotation shafts 61 is configured to be capable of pivoting along an axial line (pivoting central axis line) on the same axis extending in the X directions. The rotation shaft 61 is assembled onto the frame member 53 (refer to FIG. 3) to be capable of pivoting.

The support portion 62 is configured as a pair, one provided for each rotation shaft 61 of the pair of rotation shafts 61. The support portion 62 is disposed between the rotation shaft 61 and the valve body 63 and connects the rotation shaft 61 and the valve body 63 to each other. The support portion 62 is disposed along the inside surface of the air intake passage 80. The support portion 62 is formed in a fan shape (a triangular shape) extending in a direction orthogonal to the X directions. The rotation shaft 61 is disposed in the vicinity of one corner portion of the triangular shape of the support portion 62. Therefore, TCV 60 has a letter U shaped cross-section in a case in which the TCV 60 is viewed along the air intake flow direction (refer to FIG. 6).

The valve body 63 has a substantially upward-facing convex arc shape as viewed from the X directions. In detail, as illustrated in FIG. 3, the valve body 63 includes the flat blade surface 63*a* and the outer peripheral surface 63*b*. The outer peripheral surface 63*b* is positioned on the Z1 direction side (the top side) of the blade surface 63*a* and has an upward-facing convex arc shape. The valve body 63 is configured to open and close the main opening portion 83 of the air intake passage 80 by pivoting around the axial line extending in the X directions of the rotation shaft 61. In other words, the TCV 60 is configured to change the opening area of the main opening portion 83 to control the flow of the intake air by causing the valve body 63 to pivot.

The directions in which the rotation shaft 61 extends match the X directions which are the directions in which the cylinders 11*a* to 11*d* (refer to FIG. 1) are arranged. The valve body 63 is controlled in a non-stepwise manner by the operation of the actuator 70 (refer to FIG. 1) to assume an arbitrary posture between a fully closed state illustrated in FIGS. 2 and 3 and a fully open state in which the valve body 63 is completely stored in the valve body storage portion 53*a* as illustrated in FIG. 4. A configuration is adopted in which, when the TCV 60 is closed, the main opening portion 83 is formed by the blade surface 63*a* of the valve body 63 and the top-side inner surface 82 of the air intake passage 80.

Configuration of Sub-Opening Portion

As illustrated in FIG. 3, the sub-opening portion 90 is provided between the outer peripheral surface 63*b* of the valve body 63 and the inner surface 531 of the valve body storage portion 53*a*. In other words, the sub-opening portion 90 is configured not to move when the valve body 63 pivots around the rotation shaft 61.

Here, the sub-opening portion 90 of the first embodiment is configured to allow a portion of the intake air to pass through and discharges the intake air toward the intake air which passes through the main opening portion 83 when the main opening portion 83 is closed (including a completely closed state). The sub-opening portion 90 does not pivot together with the valve body 63 even if the valve body 63 pivots around the rotation shaft 61. Therefore, the sub-opening portion 90 is configured to continuously discharge the intake air which passes through the sub-opening portion 90 in the same direction even if the valve body 63 pivots around the rotation shaft 61.

The sub-opening portion 90 is formed by a groove portion 91 which is provided in the valve body 63 and extends along the flow direction of the intake air which flows through the sub-opening portion 90.

Figure 6:
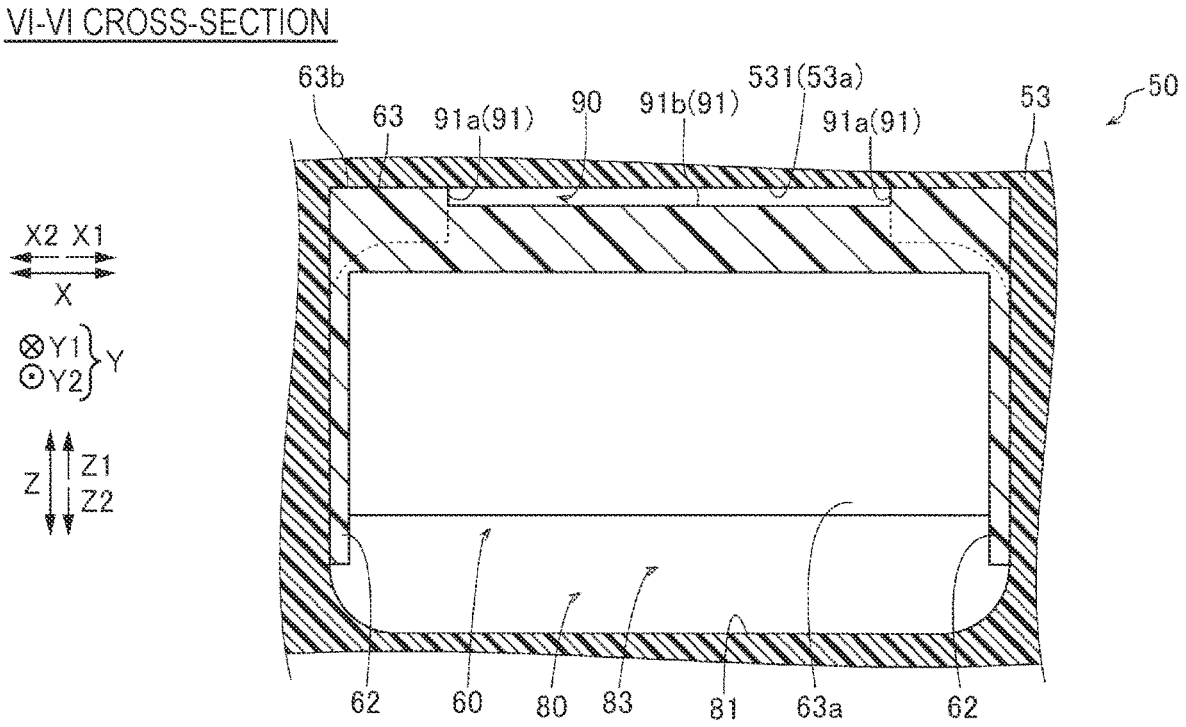
FIG. 6 is a sectional diagram taken along a VI-VI line of FIG. 3.

As illustrated in FIG. 6, the center position of the sub-opening portion 90 (the groove portion 91) in the width directions (the X directions) matches the center position of the valve body 63 in the width directions (the X directions). The sub-opening portion 90 (the groove portion 91) includes a pair of side surfaces 91*a* which oppose each other in the X directions and extend in a direction intersecting the X directions and a bottom surface 91*b* which extends in the X directions to join the lower ends of the pair of side surfaces 91*a*. The bottom surface 91*b* extends along the flow direction of the intake air which flows through the sub-opening portion 90.

The sub-opening portion 90 is configured such that the opening area in a cross-section orthogonal to the flow direction of the intake air which flows through the sub-opening portion 90 is substantially constant in the flow direction of the intake air which flows through the sub-opening portion 90.

As illustrated in FIG. 4, the valve body 63 includes a sealing portion 630 which is provided on the end portion of the outer peripheral surface 63*b* on the downstream side. The sealing portion 630 is configured to be in contact with the inner surface 531 of the valve body storage portion 53*a* to seal the sub-opening portion 90 when the main opening portion 83 (the valve body 63) is fully open (when the blade surface 63*a* is flush with the top-side inner surface 82 of the air intake passage 80). The intake air from only the main opening portion 83 is pumped to the combustion chamber 6 due to the sub-opening portion 90 being blocked by the sealing portion 630.

Figure 7:
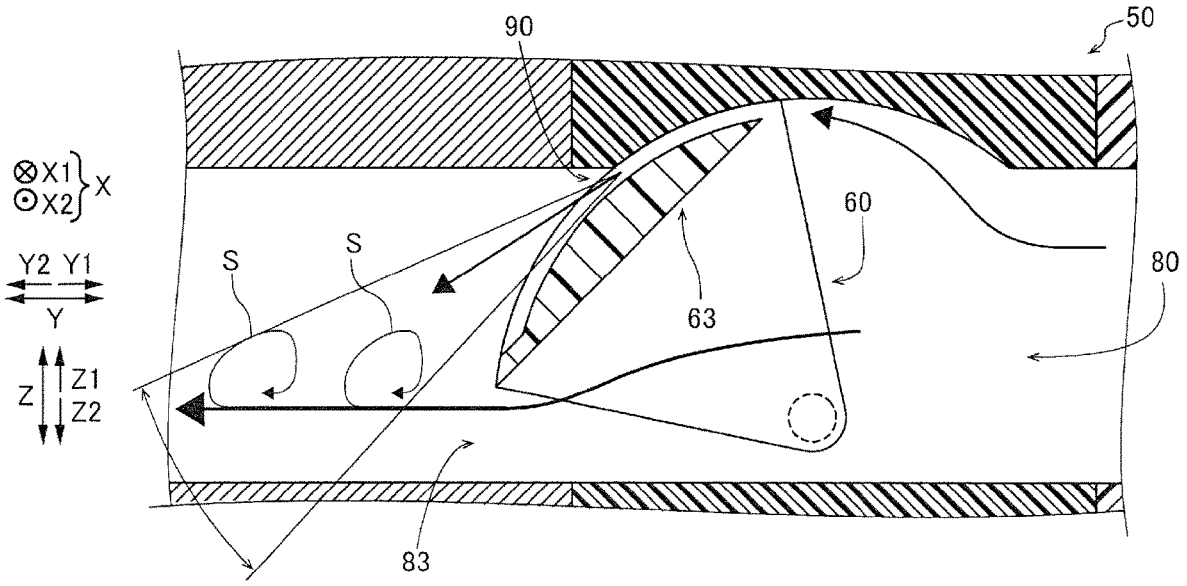
FIG. 7 is a view for explaining straightening of intake air which passes through a main opening portion using intake air which passes through a sub-opening portion.

Straightening of Intake Air Passing Through Main Opening Portion Using Intake Air Passing Through Sub-Opening Portion Next, a description will be given of the straightening of the intake air which passes through the main opening portion 83 using the intake air which passes through the sub-opening portion 90, with reference to FIG. 7.

Inside the air intake passage 80, a portion of the intake air which is restricted by the valve body 63 such that the flow speed of the intake air increases and passes through the main opening portion 83 is sucked into the downstream side (the reverse side) of the valve body 63, caused by the downstream side (the reverse side) of the valve body 63 assuming a negative pressure. Therefore, a plurality of vortexes S heading toward the valve body 63 side (the Z1 direction side) with respect to the intake air which passes through the main opening portion 83 are generated inside the air intake passage 80.

The sub-opening portion 90 nullifies the vortexes S to straighten the intake air which passes through the main opening portion 83 by discharging the intake air which passes through the sub-opening portion 90 toward the vortexes S from the downstream side (the reverse side) (the negative pressure side) of the valve body 63. As a result, it is possible to suppress a reduction in the flow speed of the intake air which passes through the main opening portion 83 and the tumble ratio is improved.

Effects of First Embodiment

In the first embodiment, it is possible to obtain the following effects.

In the first embodiment, as described above, the sub-opening portion 90 which allows a portion of the intake air to pass therethrough to be discharged toward the intake air which passes through the main opening portion 83 when the main opening portion 83 is closed is provided between the outer peripheral surface 63*b* of the valve body 63 and the inner surface 531 of the valve body storage portion 53*a*. Accordingly, since the sub-opening portion 90 is provided between the outer peripheral surface 63*b* of the valve body 63 and the inner surface 531 of the valve body storage portion 53*a* instead of being provided directly in the TCV 60, it is possible to continuously discharge the intake air in the same direction from the sub-opening portion 90 without pivoting the sub-opening portion 90, even if the TCV 60 pivots. Therefore, it is possible to cause the intake air which is discharged from the sub-opening portion 90 to collide with the intake air which passes through the main opening portion 83 at substantially the same position. As a result, it is possible to effectively perform the straightening of the intake air which passes through the main opening portion 83 using the intake air which passes through the sub-opening portion 90. Therefore, since it is possible to suppress a reduction in the flow speed of the intake air which passes through the main opening portion 83, it is possible to improve the tumble ratio and to improve the fuel efficiency of the engine 100.

In the first embodiment, as described above, the sub-opening portion 90 is formed by the groove portion 91 which is provided in the valve body 63 and extends along the flow direction of the intake air which passes through the sub-opening portion 90. In this configuration, it is possible to form the sub-opening portion 90 between the outer peripheral surface 63*b* of the valve body 63 and the inner surface 531 of the valve body storage portion 53*a* using the groove portion 91 which has a simple shape.

In the first embodiment, as described above, the valve body 63 includes the sealing portion 630 which is provided on the end portion on the downstream side of the outer peripheral surface 63*b* and comes into contact with the inner surface 531 of the valve body storage portion 53*a* to seal the sub-opening portion 90 when the main opening portion 83 is opened. Accordingly, it is possible to prevent the intake air from being discharged from the sub-opening portion 90 using the sealing portion 630 when the main opening portion 83 is opened. In other words, it is possible to nullify the influence of the intake air which passes through the sub-opening portion 90 on the intake air which passes through the main opening portion 83 when the straightening of the intake air which passes through the main opening portion 83 becomes unnecessary (when the TCV 60 is fully open).

Second Embodiment

A description will be given of the second embodiment with reference to FIGS. 8 and 9. In the second embodiment, a description will be given of an example in which the shape of a sub-opening portion 290 is rendered different from the shape of the sub-opening portion 90 of the first embodiment. In the figures, configurations that are the same as those of the first embodiment are depicted with the same reference numerals as in the first embodiment.

Figure 8:
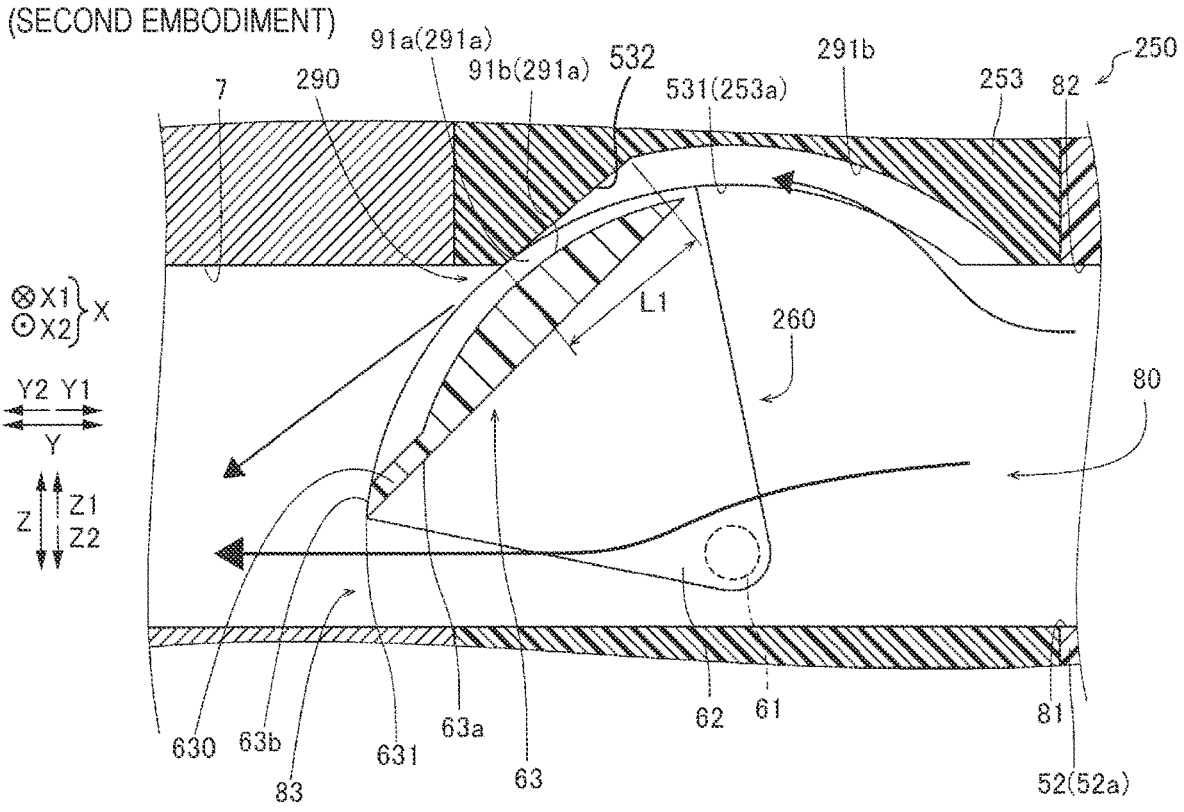
FIG. 8 is a view illustrating a state of an air intake flow while the TCV valve is closed according to a second embodiment disclosed here.

As illustrated in FIG. 8, an air intake apparatus 250 according to the second embodiment is provided with a frame member 253 including a valve body storage portion 253*a*, a TCV 260 (an example of an air intake flow control valve), and the sub-opening portion 290.

The sub-opening portion 290 is configured to pass a portion of the intake air therethrough and discharges the intake air toward the intake air which passes through the main opening portion 83 when the main opening portion 83 is closed (including a completely closed state).

Figure 9:
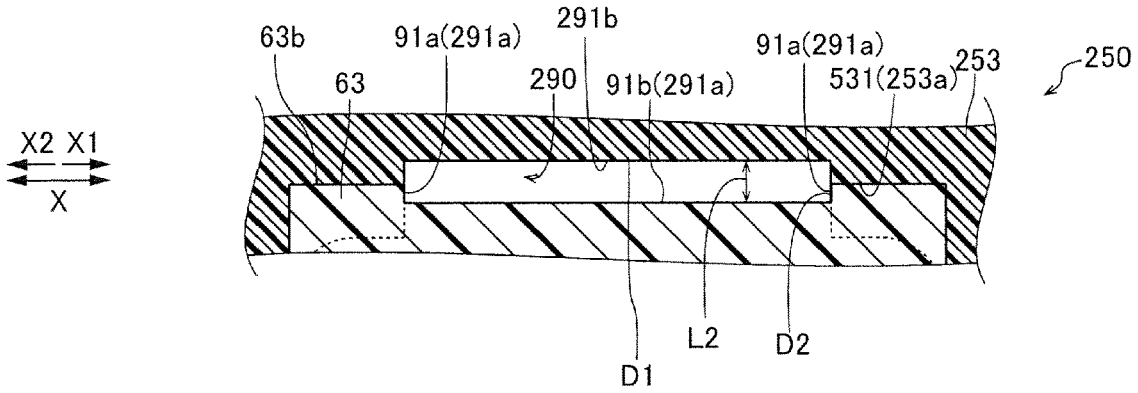
FIG. 9 is a view illustrating a cross-section of a passage of a bottommost flow portion of the sub-opening portion according to the second embodiment disclosed here.

As illustrated in FIG. 9, the sub-opening portion 290 is formed by groove portions 291*a* and 291*b* which are provided in the valve body 63 and the valve body storage portion 253*a*, respectively, and extend along the flow direction of the intake air which passes through the sub-opening portion 290. The groove portion 291*b* which is provided in the valve body storage portion 253*a* is formed in a recessed shape which is depressed upward. The lengths of the groove portions 291*a* and 291*b* are equal in the width directions (the X directions).

As illustrated in FIG. 8, the passage cross-sectional area of the sub-opening portion 290 changes so as to gradually increase toward the downstream side from the upstream side in the flow direction of the intake air. In detail, the passage cross-sectional area of the sub-opening portion 290 on the groove portion 291*a* side which is provided in the valve body 63 changes so as to gradually increase toward the downstream side from the upstream side in the flow direction of the intake air due to changing the size (the depth) in the Z directions without changing the size in the width directions (the X directions) of the sub-opening portion 290. The passage cross-sectional area of the valve body storage portion 253*a* side does not substantially change toward the downstream side from the upstream side in the flow direction of the intake air.

Accordingly, the sub-opening portion 290 is configured such that the ratio of the passage cross-sectional area (the passage cross-sectional area of the downstream side end portion which discharges the intake air) of the sub-opening portion 290 to the passage cross-sectional area of the main opening portion 83 is substantially constant. For example, the TCV 260 is configured to pivot while keeping the passage cross-sectional area (the passage cross-sectional area of the downstream side end portion which discharges the intake air) of the sub-opening portion 290 at 15% of the size of the passage cross-sectional area of the main opening portion 83. It is preferable that the passage cross-sectional area (the passage cross-sectional area of the downstream side end portion which discharges the intake air) of the sub-opening portion 290 be greater than or equal to 10% and less than or equal to 20% of the size of the passage cross-sectional area of the main opening portion 83. The sub-opening portion 290 changes the passage cross-sectional area to gradually increase toward the downstream side from the upstream side in the flow direction of the intake air while maintaining this proportion (this ratio). In other words, the passage cross-sectional area of the sub-opening portion 290 increases as the passage cross-sectional area of the main opening portion 83 increases in accordance with the pivoting of the TCV 260. The passage cross-sectional area of the sub-opening portion 290 decreases as the passage cross-sectional area of the main opening portion 83 decreases in accordance with the pivoting of the TCV 260.

The inner surface 531 of the valve body storage portion 253*a* includes a flat surface portion 532 which is flat, is provided on the end portion on the downstream side in the flow direction of the intake air, and controls (directs) the flow direction of the intake air which passes through the sub-opening portion 290 to be a predetermined direction. The intake air which passes through the sub-opening portion 290 is discharged toward the downstream side in a direction running along the flat surface portion 532 due to the intake air which passes through the sub-opening portion 290 flowing along the flat surface portion 532.

As illustrated in FIG. 9, the passage cross-section of the sub-opening portion 290 is formed in a rectangular shape having a long edge D1 which extends in the axial directions (the X directions) of the rotation shaft 61 and a short edge D2 which extends in a direction orthogonal to the long edge D1. A length L1 (refer to FIG. 8) of the flat surface portion 532 in the air intake flow direction (the direction in which the intake air is discharged from the sub-opening portion 290) inside the sub-opening portion 290 is greater than or equal to a length L2 of the short edge D2 at the most downstream portion of the sub-opening portion 290. The length of the flat surface portion 532 is equal to the size of the sub-opening portion 290 (the groove portion 291*b*) in the width directions (the X directions).

The other configurations of the second embodiment are similar to those of the first embodiment.

Effects of Second Embodiment

In the second embodiment, it is possible to obtain the following effects.

In the second embodiment, as described above, the passage cross-sectional area of the sub-opening portion 290 fluctuates in accordance with the pivoting of the TCV 260. Here, the opening area of the main opening portion 83 fluctuates in accordance with the pivoting of the TCV 260. Therefore, it is possible to change the passage cross-sectional area (the passage cross-sectional area of the downstream side end portion) of the sub-opening portion 290 to discharge the intake air having an optimal flow rate and flow speed at which the straightening of the intake air which passes through the main opening portion 83 may be effectively performed from the sub-opening portion 290 according to the changing of the opening area of the main opening portion 83 in accordance with the pivoting of the TCV 260.

In the second embodiment, as described above, the inner surface 531 of the valve body storage portion 253*a* includes the flat surface portion 532 which is provided on the end portion on the downstream side in the flow direction of the intake air and controls the flow direction of the intake air which passes through the sub-opening portion 290 to be a predetermined direction. Accordingly, since it is possible to give the intake air which passes through the sub-opening portion 290 a directionality toward the intake air which passes through the main opening portion 83, it is possible to more effectively perform the straightening of the intake air which passes through the main opening portion 83 using the air which passes through the sub-opening portion 290.

The other effects of the second embodiment are similar to those of the first embodiment.

Modification Example

It should be understood that the embodiments disclosed herein have been presented for the purpose of illustration but not limited in all aspects. It is intended that the scope disclosed here is indicated not by the description of the embodiments but by the scope of the appended claims and encompasses all modifications (modification examples) equivalent in meaning and scope to the appended claims.

Figure 10:
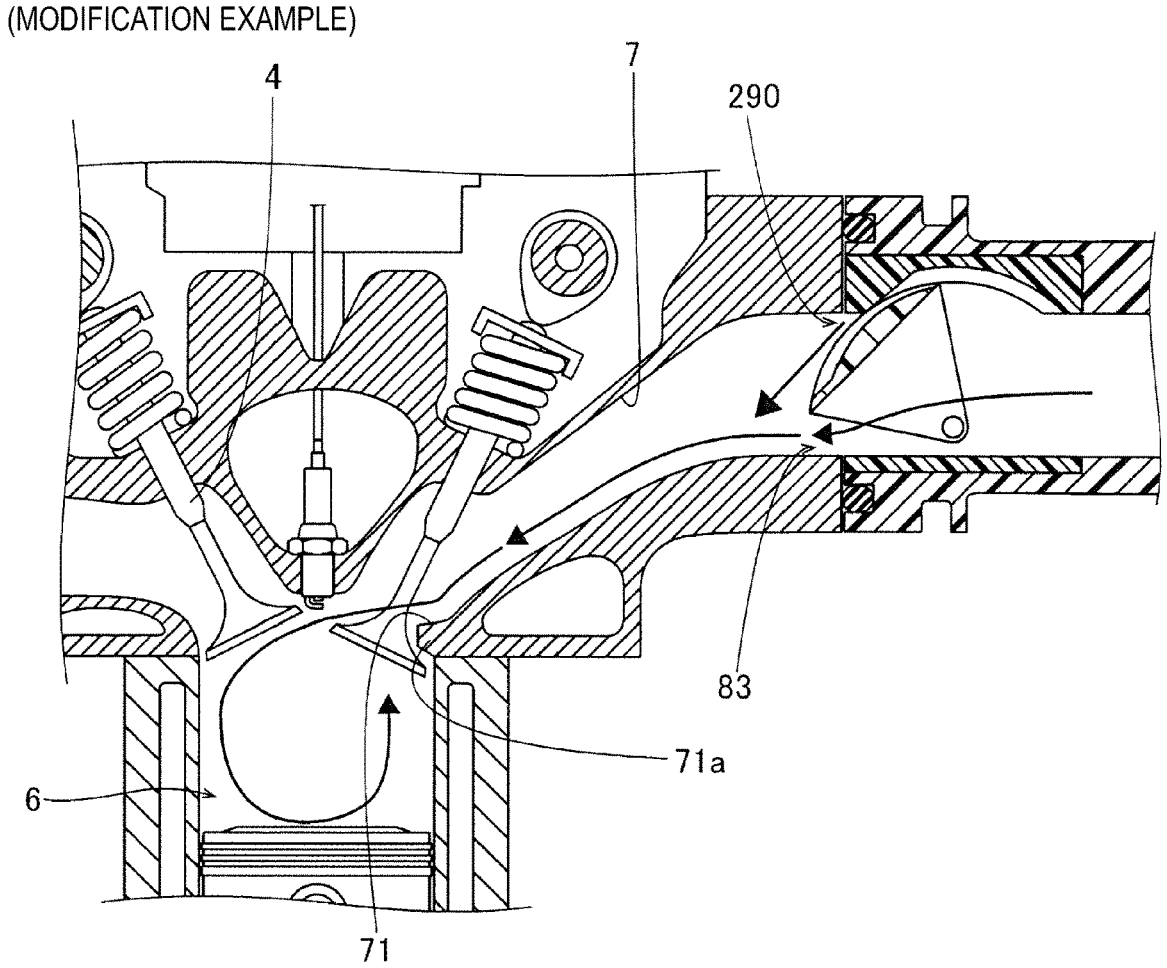
FIG. 10 is a sectional diagram illustrating a structure of an engine and an air intake apparatus according to a modification example disclosed here.

For example, in addition to the configurations of the first and second embodiments, as in the modification example illustrated in FIG. 10, an inner surface (the inner surface at a most downstream position 71) which is positioned most downstream of the air intake port 7 and is on the downstream side in the flow direction of the intake air which flows through the sub-opening portion 290 may be formed to curve and face the top side inside the combustion chamber 6. In other words, a protruding portion 71*a* which protrudes toward the inside of the combustion chamber 6 may be provided on the most downstream position 71. The top surface of the protruding portion 71*a* faces the vicinity of the exhaust valve 4. Accordingly, when the intake air is introduced to the inside of the combustion chamber 6 from the air intake port 7, it is possible to orient, in a direction in which a tumble flow is easily generated, the intake air which flows along the inner surface which is the downstream side in the flow direction of the intake air which flows through the sub-opening portion 290, of the intake air which flows through the air intake port 7. The air which flows along the inner surface is mainly the intake air which is restricted by the valve body 63 to increase in flow speed, is straightened by the intake air which passes through the sub-opening portion 290, and passes through the main opening portion 83. As a result, it is possible to improve the tumble ratio to improve the fuel efficiency of the engine 100.

Although an example is depicted in which the valve body storage portion is provided on the top-side inner surface of the air intake passage in the first and second embodiments, the disclosure is not limited thereto. In the disclosure, the valve body storage portion may be provided on the bottom-side inner surface of the air intake passage.

In the second embodiment, although an example is depicted in which the passage cross-sectional area of the sub-opening portion is changed to gradually increase in size toward the downstream side from the upstream side in the flow direction of the intake air, the disclosure is not limited thereto. In the disclosure, the passage cross-sectional area of the sub-opening portion may be changed to gradually decrease in size toward the downstream side from the upstream side in the flow direction of the intake air.

In the first embodiment, an example is depicted in which the sub-opening portion is formed by the groove portion which is provided only in the valve body, and in the second embodiment, an example is depicted in which the sub-opening portion is formed by groove portions which are provided in each of the valve body and the valve body storage portion. However, the disclosure is not limited thereto. In the disclosure, the sub-opening portion may be formed by a groove portion which is provided only in the valve body storage portion.

In the second embodiment, although an example is depicted in which the depth of the groove portion which forms the sub-opening portion is gradually modified toward the downstream side from the upstream side, the disclosure is not limited thereto. In the disclosure, the width (the size in the X directions) of the groove portion which forms the sub-opening portion may be gradually modified toward the downstream side from the upstream side.

Although an example is depicted in which one sub-opening portion is provided in the air intake flow control valve in the first and second embodiments, the disclosure is not limited thereto. In the disclosure, a plurality of sub-opening portions may be provided in the air intake flow control valve.

Although an example is depicted in which the air intake flow control valve is provided with the sealing portion in the first and second embodiments, the disclosure is not limited thereto. In the disclosure, the air intake flow control valve may not be provided with the sealing portion.

Although an example is depicted in which the sub-opening portion is configured by a rectangular groove portion in the first and second embodiments, the disclosure is not limited thereto. In the disclosure, the sub-opening portion may be configured by an arc-shaped groove portion or the like.

In the air intake apparatus of the internal-combustion engine according to the first aspect it is preferable that the sub-opening portion is formed by a groove portion which is provided in at least one of the valve body storage portion and the valve body and extends along a flow direction of the intake air which flows through the sub-opening portion.

In this configuration, since it is possible to form the sub-opening portion between the outer peripheral surface of the valve body and the inner surface of the valve body storage portion using the groove portion which has a simple shape, it is possible to simplify the structure of the sub-opening portion.

In the air intake apparatus of the internal-combustion engine according to the first aspect, it is preferable that a passage cross-sectional area of the sub-opening portion fluctuates in accordance with pivoting of the air intake flow control valve.

Here, the opening area of the main opening portion fluctuates in accordance with the pivoting of the air intake flow control valve. Therefore, in this configuration, it is possible to change the passage cross-sectional area (the passage cross-sectional area of the downstream side end portion) of the sub-opening portion to discharge the intake air having an optimal flow rate and flow speed at which the straightening of the intake air which passes through the main opening portion may be effectively performed from the sub-opening portion according to the changing of the opening area of the main opening portion in accordance with the pivoting of the air intake flow control valve.

In the air intake apparatus of the internal-combustion engine according to the first aspect, it is preferable that the inner surface of the valve body storage portion includes a flat surface portion which is provided at an end portion on a downstream side in the flow direction of the intake air and controls the flow direction of the intake air which passes through the sub-opening portion to be a predetermined direction.

In this configuration, since it is possible to give the intake air which passes through the sub-opening portion a directionality toward the intake air which passes through the main opening portion, it is possible to more effectively perform the straightening of the intake air which passes through the main opening portion using the intake air which passes through the sub-opening portion.

In the air intake apparatus of the internal-combustion engine according to the first aspect, it is preferable that the valve body includes a sealing portion which is provided on an end portion on a downstream side of the outer peripheral surface and comes into contact with the inner surface of the valve body storage portion to seal the sub-opening portion when the main opening portion is opened.

In this configuration, it is possible to prevent the intake air from being discharged from the sub-opening portion using the sealing portion when the main opening portion is opened. In other words, it is possible to nullify the influence of the intake air which passes through the sub-opening portion on the intake air which passes through the main opening portion when the straightening of the intake air which passes through the main opening portion becomes unnecessary (when the air intake flow control valve is fully open).

In the air intake apparatus of the internal-combustion engine according to the first aspect in which the inner surface of the valve body storage portion includes a flat surface portion, it is preferable that a cross-section of a passage of the sub-opening portion is formed in a rectangular shape having a long edge which extends in an axial direction of the rotation shaft and a short edge which extends in a direction orthogonal to the long edge and a length of the flat surface portion in the flow direction of the intake air is greater than or equal to a length of the short edge at a most downstream portion of the sub-opening portion.

In this configuration, since it is possible to reliably secure a predetermined length in the flow direction in which the intake air which passes through the sub-opening portion is oriented in the flat surface portion, it is possible to more effectively perform the straightening of the intake air which passes through the main opening portion using the intake air which passes through the sub-opening portion.

In the air intake apparatus of the internal-combustion engine according to the first aspect in which the sub-opening portion is formed by groove portions which are provided in at least one of the valve body storage portion and the valve body, it is preferable that the sub-opening portion is formed by a groove portion which is provided in each of the valve body storage portion and the valve body.

In this configuration, since it is possible to form the sub-opening portion in more varied shaped as compared to a case in which the sub-opening portion is provided in only one of the valve body storage portion and the valve body, it is possible to form the sub-opening portion in a shape in which it is possible to more effectively perform the straightening of the intake air which passes through the main opening portion.

In the air intake apparatus of the internal-combustion engine according to the first aspect, an inner surface which is positioned most downstream of an air intake port and is on a downstream side in a flow direction of the intake air which flows through the sub-opening portion is curved to face a top side inside the combustion chamber.

In this configuration, when the intake air is introduced to the inside of the combustion chamber from the air intake port, it is possible to orient, in a direction in which a tumble flow is easily generated, the intake air which flows along the inner surface which is the downstream side in the flow direction of the intake air which flows through the sub-opening portion, of the intake air which flows through the air intake port. The air which flows along the inner surface is mainly the intake air which is restricted by the valve body to increase in flow speed, is straightened by the intake air which passes through the sub-opening portion, and passes through the main opening portion. As a result, it is possible to improve the tumble ratio to improve the fuel efficiency of the internal-combustion engine.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An air intake apparatus of an internal-combustion engine, comprising:

an air intake passage which communicates with a combustion chamber of the internal-combustion engine and supplies an intake air to the combustion chamber;

an air intake flow control valve including a rotation shaft which is provided in the air intake passage and a valve body which has a convex arc-shaped outer peripheral surface and opens and closes a main opening portion of the air intake passage by pivoting around an axial line of the rotation shaft, the air intake flow control valve controlling a flow of the intake air by pivoting the valve body when the main opening portion is closed;

a valve body storage portion which is provided in the air intake passage to have a concave arc shape corresponding to a shape of the outer peripheral surface of the valve body and which stores the valve body when the main opening portion is opened by virtue of movement of the valve body relative to the valve body storage portion; and a sub-opening portion which is provided between the outer peripheral surface of the valve body and an inner surface of the valve body storage portion, allows a portion of the intake air to pass therethrough and discharges the portion of the intake air toward the intake air which passes through the main opening portion when the main opening portion is closed.

2. The air intake apparatus of the internal-combustion engine according to claim 1, wherein the sub-opening portion is formed by a groove portion which is provided in at least one of the valve body storage portion and the valve body and extends along a flow direction of the intake air which flows through the sub-opening portion.

3. The air intake apparatus of the internal-combustion engine according to claim 1, wherein a passage cross-sectional area of the sub-opening portion fluctuates in accordance with pivoting of the air intake flow control valve.

4. The air intake apparatus of the internal-combustion engine according to claim 1, wherein the inner surface of the valve body storage portion includes a flat surface portion which is provided at an end portion on a downstream side in the flow direction of the intake air and controls the flow direction of the intake air which passes through the sub-opening portion to be a predetermined direction.

5. The air intake apparatus of the internal-combustion engine according to claim 4, wherein a cross-section of a passage of the sub-opening portion is formed in a rectangular shape having a long edge which extends in an axial direction of the rotation shaft and a short edge which extends in a direction orthogonal to the long edge and a length of the flat surface portion in the flow direction of the intake air is greater than or equal to a length of the short edge at a most downstream portion of the sub-opening portion.

6. The air intake apparatus of the internal-combustion engine according to claim 1, wherein the valve body includes a sealing portion which is provided on an end portion on a downstream side of the outer peripheral surface and comes into contact with the inner surface of the valve body storage portion to seal the sub-opening portion when the main opening portion is opened.

7. The air intake apparatus of the internal-combustion engine according to claim 1, wherein the sub-opening portion is formed by a groove portion which is provided in each of the valve body storage portion and the valve body.

8. The air intake apparatus of the internal-combustion engine according to claim 1, wherein an inner surface which is positioned most downstream of an air intake port of the internal-combustion engine and is on a downstream side in a flow direction of the intake air which flows through the sub-opening portion is curved to face a top side inside the combustion chamber.

9. An air intake flow control valve comprising:

a rotation shaft which is provided in an air intake passage; and a valve body which has a convex arc-shaped outer peripheral surface and opens and closes a main opening portion of the air intake passage by pivoting around an axial line of the rotation shaft, wherein the air intake flow control valve is configured to control a flow of the intake air by pivoting the valve body when the main opening portion is closed and to allow a sub-opening portion which is provided between an outer peripheral surface of the valve body and an inner surface of a valve body storage portion, which is provided in the air intake passage to have a concave arc shape corresponding to a shape of the outer peripheral surface of the valve body and which stores the valve body when the main opening portion is opened by virtue of movement of the valve body relative to the valve body storage portion, to pass a portion of the intake air therethrough to discharge the portion of the intake air toward the intake air which passes through the main opening portion when the main opening portion is closed.

* * * * *